US011292633B2

(12) United States Patent
Wisecarver et al.

(10) Patent No.: US 11,292,633 B2
(45) Date of Patent: Apr. 5, 2022

(54) LEAK PROOF CONTAINER WITH PUSH LOCK BODY

(71) Applicant: INTERNATIONAL PAPER COMPANY, Memphis, TN (US)

(72) Inventors: Mark Anthony Wisecarver, Morristown, TN (US); James William Sloan, II, Edgefield, SC (US); Kenneth Calvin Hyatt, Springdale, AR (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 318 days.

(21) Appl. No.: 16/572,809

(22) Filed: Sep. 17, 2019

(65) Prior Publication Data

US 2021/0078756 A1 Mar. 18, 2021

(51) Int. Cl.

| | |
|---|---|
| ***B65D 5/24*** | (2006.01) |
| ***B65D 5/42*** | (2006.01) |
| ***B65D 5/40*** | (2006.01) |
| ***B31B 50/73*** | (2017.01) |
| ***B31B 50/26*** | (2017.01) |
| *B31B 110/35* | (2017.01) |
| *B31B 120/70* | (2017.01) |
| *B31B 120/30* | (2017.01) |

(52) U.S. Cl.

CPC ..... *B65D 5/247* (2013.01); *B31B 50/26* (2017.08); *B31B 50/732* (2017.08); *B65D 5/40* (2013.01); *B65D 5/4279* (2013.01); *B31B 2110/35* (2017.08); *B31B 2120/302* (2017.08); *B31B 2120/70* (2017.08)

(58) Field of Classification Search

CPC ..... B65D 5/4279; B65D 5/244; B65D 5/28; B65D 5/4266; B65D 5/248

USPC ..... 229/190, 186, 171, 5.84, 132, 122.32, 229/180

See application file for complete search history.

(56) References Cited

U.S. PATENT DOCUMENTS 2,428,845 A * 10/1947 Guyer ..... B65D 5/4279 229/154
2,443,431 A * 6/1948 Ringler ..... B65D 75/14 229/142
2,859,906 A * 11/1958 Guyer ..... B65D 5/248 229/175
2,909,105 A * 10/1959 Lawrence ..... B31B 50/00 493/137

(Continued)

*Primary Examiner* — Christopher R Demeree
(74) *Attorney, Agent, or Firm* — Michael D. Folkerts; Thomas W. Ryan

(57) ABSTRACT

A leak proof container and a method of forming the container from a blank. The blank includes a bottom panel, first and second side panels connected to the bottom panel at opposing lateral edges, and first and second end portions located at opposing longitudinal ends of the blank. Each end portion includes an inner end panel connected to the bottom panel, an outer end panel connected to the inner end panel, and first and second corner panels, each corner panel having an edge connected to a respective one of the first and second side panels and having an edge connected to the inner end panel. First and second locking tabs are defined in the outer end panel, each locking tab being defined by a lateral separation line located longitudinally inward from an outer longitudinal edge of the outer end panel and extending laterally to define a free tab end.

15 Claims, 3 Drawing Sheets

(56) References Cited

U.S. PATENT DOCUMENTS

| | | | | | |
|---|---|---|---|---|---|
| 3,008,626 | A | * | 11/1961 | Lawrence | B65D 5/247 229/150 |
| 3,102,674 | A | * | 9/1963 | Hamilton | B65D 5/48048 229/117.21 |
| 3,511,429 | A | * | 5/1970 | Brian | B65D 5/247 229/171 |
| 3,670,881 | A | | 6/1972 | Dutcher | |
| 3,904,106 | A | * | 9/1975 | Elder | B65D 5/2076 229/149 |
| 4,214,695 | A | * | 7/1980 | Cooper | B65D 5/248 229/143 |
| 4,306,658 | A | * | 12/1981 | Montealegre | B65D 81/343 229/101 |
| 4,340,169 | A | | 7/1982 | Webinger | |
| 4,531,669 | A | | 7/1985 | Osborne | |
| 4,930,639 | A | * | 6/1990 | Rigby | B65D 5/5455 229/120 |
| 5,217,159 | A | | 6/1993 | Calvert | |
| 5,358,176 | A | | 10/1994 | Rigby | |
| 5,411,204 | A | * | 5/1995 | DeMay | B65D 5/2047 229/114 |
| 5,415,340 | A | | 5/1995 | Calvert | |
| 5,638,978 | A | * | 6/1997 | Cadiente | B65D 5/244 229/103.11 |
| 6,186,931 | B1 | | 2/2001 | Calvert | |
| 8,567,661 | B2 | | 10/2013 | Sullivan | |
| 9,216,837 | B2 | | 12/2015 | Hubbard | |
| 10,577,145 | B2 | | 3/2020 | Bevier | |
| 2016/0001917 | A1 | | 1/2016 | Gould | |

* cited by examiner

LEAK PROOF CONTAINER WITH PUSH LOCK BODY

FIELD OF THE INVENTION

The present disclosure relates to containers or trays formed from a blank of material and, more particularly, to a container that is formed with a leak proof construction for retaining moisture or fluid within the container.

BACKGROUND OF THE INVENTION

In some applications of containers or trays formed of folded material such as paperboard material, e.g., corrugated paperboard, the container or tray may be configured to receive products having moisture or a fluid content that can leak into a base portion of the container or tray. In a known use of a container, a package containing protein parts of poultry may be supported within the container and the container can prevent leakage of fluids outside of the container.

For example, one known type of container can be formed from a blank of corrugated material wherein a bottom panel and a plurality of side panels may be formed of a unitary construction from a die cut and scored sheet of material. It is also known to provide such a container construction wherein the corners adjacent to the bottom are sealed. In such a container construction, the side panels can be integrally connected to the bottom panel along respective fold lines, and adjacent side panels can be connected by a folded gusset or web that is disposed at each corner to essentially configure the corners as leak proof connections between panels. While such container constructions can facilitate containing and handing of food products, such as in a food processing plant, one known problem that may be associated with leakproof containers is the potential of foreign object contamination. For example, in production processes for corrugated container blanks configurated and used for forming current leakproof containers, there is potential for corrugated trim to remain attached to the container blank. Hence, there remains a possibility that trim debris may release from a container to contaminate the container contents, such as when containers are assembled manually or mechanically and/or when containers are positioned in close relation to each other as trim falls in between stacked containers during manufacturing, wherein the trim can find its way into assembled boxes filled with product.

SUMMARY OF THE INVENTION

In accordance with an aspect of the invention, a blank for making a leak proof container is described. The blank comprises a bottom panel having a plurality of peripheral edges. First and second side panels are connected to the bottom panel at opposing lateral peripheral edges and define lower edges of the container. First and second end portions are located at opposing longitudinal ends of the blank. Each end portion includes an inner end panel connected to a longitudinal peripheral edge of the bottom panel, an outer end panel having an inner longitudinal edge hingedly connected to a longitudinal edge of the inner end panel, first and second corner panels, each corner panel having a longitudinal edge connected to a respective one of the first and second side panels and a lateral edge connected to a lateral edge of the inner end panel. First and second locking tabs are defined in the outer end panel, each locking tab being defined by a lateral separation line located longitudinally inward from an outer longitudinal edge of the outer end panel and extending laterally to define a free tab end.

Each lateral separation line may be defined by a first, panel edge and a second, tab edge extending to an inner end of the lateral separation line.

The first, panel edge and the second, tab edge may be colinear to the lateral separation line.

A longitudinal separation line may extend longitudinally inward from the outer longitudinal edge of the outer end panel to each of the lateral separation lines, wherein the free ends of the tabs may be defined at the longitudinal separation lines.

The longitudinal and lateral separation lines may be defined by cut lines that extend completely through the outer end panel.

The longitudinal separation lines may angle laterally inward toward each other extending from the outer longitudinal edge of the outer end panel toward a respective lateral separation line.

The lateral separation lines may be spaced from the outer longitudinal edge of the outer end panel a distance that is less than a distance from the lateral separation lines to the inner longitudinal edge of the outer end panel.

The corner panels may be formed as square panels, and may include a diagonal fold line dividing each corner panel into first and second triangular gusset panels.

Each corner panel may include a lateral edge that is colinear with a lateral edge of the blank defined by an edge of one of the first and second side panels.

A longitudinal dimension of the outer end panel may be substantially less than a longitudinal dimension of the inner end panel.

In accordance with another aspect of the invention, a container is provided including a bottom panel defining a bottom of the container and having a plurality of peripheral edges. First and second side panels are connected to the bottom panel at opposing lateral peripheral edges and folded upward relative to the bottom panel. First and second end portions are located at opposing longitudinal ends of the blank. Each end portion includes an inner end panel connected to a longitudinal peripheral edge of the bottom panel, an outer end panel having an inner longitudinal edge hingedly connected to a longitudinal edge of the inner end panel, first and second corner panels, each corner panel including longitudinal and lateral edges connected to respective edges of a side panel and the inner end panel, each corner panel folded about a diagonal gusset fold line to define a gusset, and each gusset folded perpendicular to a respective side panel to overlapping relationship with the inner end panel, and first and second locking tabs defined in the outer end panel, each locking tab defined by a lateral separation line located longitudinally inward from an outer longitudinal edge of the outer end panel and extending laterally to define a free tab end. The outer end panel is folded about the inner longitudinal edge to overlapping relationship with at least a portion of each of the gussets, and the free tab ends are positioned between a respective gusset and the inner end panel to retain the outer end panel in position over the gussets.

Each lateral separation line may be defined by a first, panel edge and an adjacent second, tab edge extending to an inner end of the lateral separation line opposite the free end of the locking tab.

The first, panel edge and the second, tab edge may be collinear to the separation line.

The gusset fold line may intersect the first, panel edge and the second, tab edge at a common intersection point.

The gusset fold line may extend from the bottom of the container to the inner longitudinal edge of the outer end panel.

A longitudinal separation line may extend longitudinally inward from the outer longitudinal edge of the outer end panel to each of the lateral separation lines, wherein the free ends of the tabs may be defined at the longitudinal separation lines.

The outer longitudinal edge of the outer end panel may be located in spaced relation from the bottom of the container.

In accordance with a further aspect of the invention, a method of forming a container from a blank is provided. The blank comprises a bottom panel having a plurality of peripheral edges, first and second side panels connected to the bottom panel at opposing lateral peripheral edges and defining lower edges of the container, first and second end portions located at opposing longitudinal ends of the blank, each end portion including an inner end panel connected to a longitudinal peripheral edge of the bottom panel, an outer end panel having an inner longitudinal edge hingedly connected to a longitudinal edge of the inner end panel, first and second corner panels, each corner panel having a longitudinal edge connected to a respective one of the first and second side panels and a lateral edge connected to a lateral edge of the inner end panel, and first and second locking tabs defined in the outer end panel, and each locking tab defined by a lateral separation line extending to a free tab end. The method includes forming an end portion of the container comprising: folding the side panels and inner end panel upward from the bottom panel, and simultaneously folding each corner panel about a diagonal gusset fold line to define a gusset; folding each gusset perpendicular to a respective side panel to overlapping relationship with the inner end panel; folding the outer end panel about the inner longitudinal edge of the outer end panel to overlapping relationship with at least a portion of each of the gussets; and positioning the free tab ends between a respective gusset and the inner end panel to retain the outer end panel in position over the gussets.

Each lateral separation line may be defined by a first, panel edge and an adjacent second, tab edge extending to an inner end of the lateral separation line opposite the free end of the locking tab.

The gusset fold line may intersect the first, panel edge and the second, tab edge at a common intersection point.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
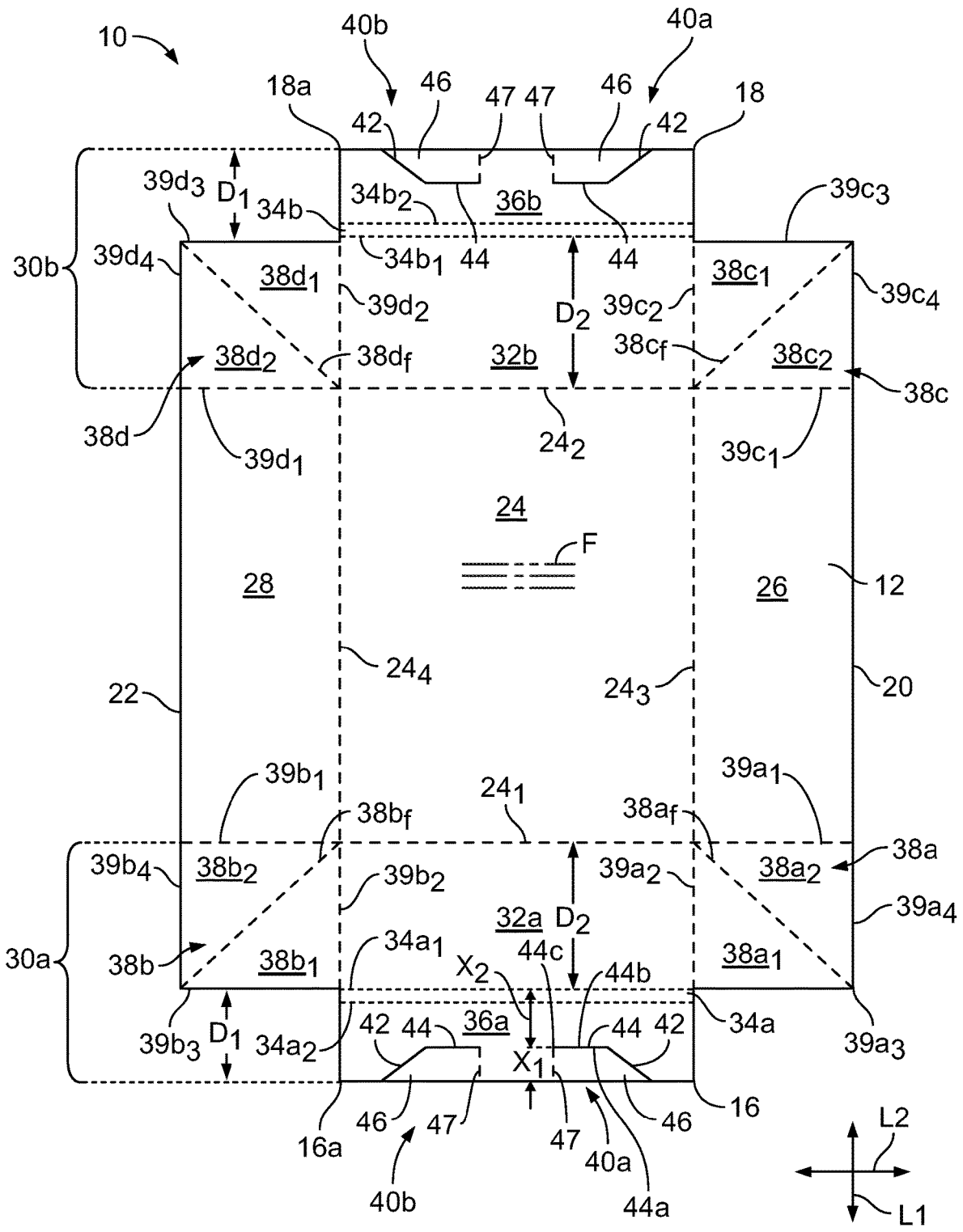
FIG. 1 is a plan view of a blank for forming a leak proof container.
Figure 2:
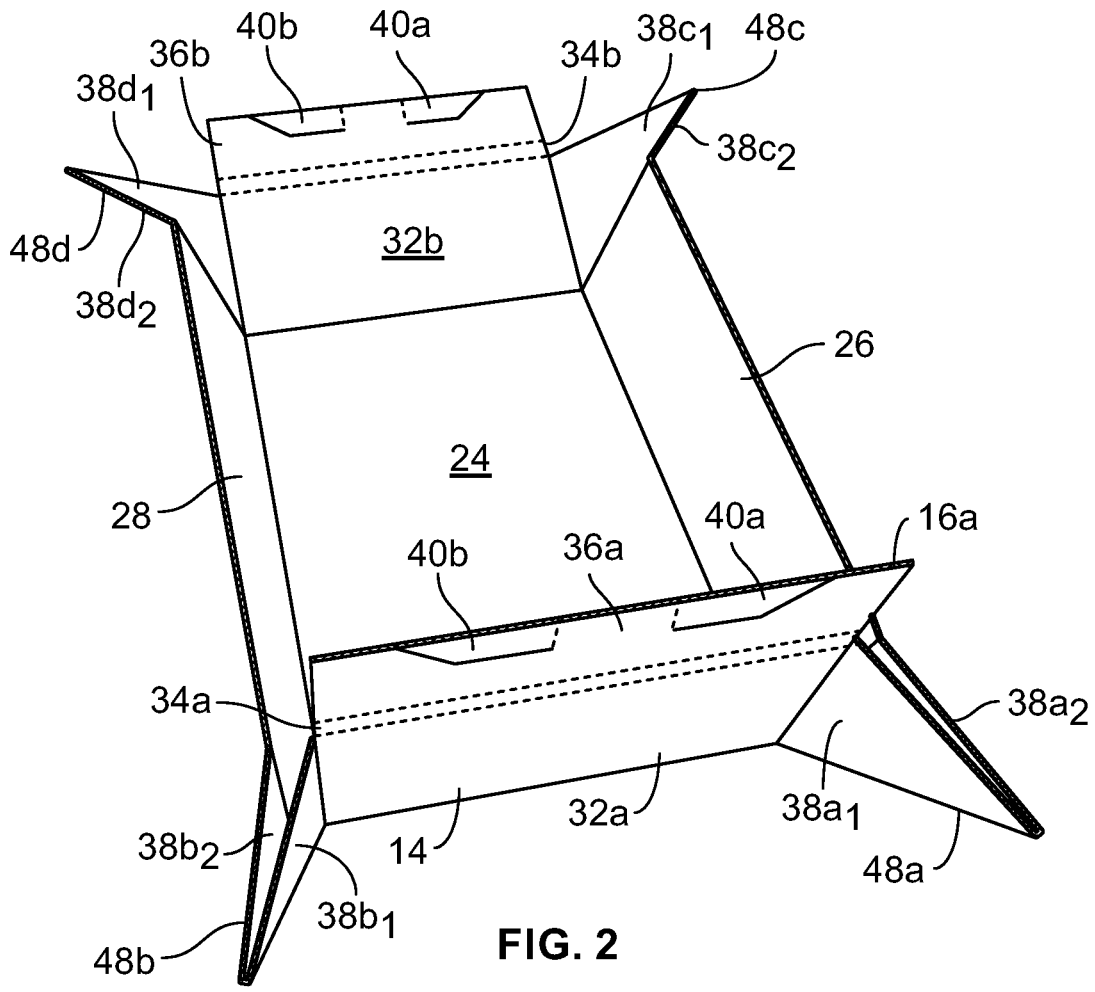
FIG. 2 is a perspective view of an initial step in folding the blank to erect the leak proof container.

Referring to FIG. 1, a die cut blank 10 is shown for illustrating one or more aspects of a container or tray comprising a leak resistant container, as described herein. In a use of the blank 10 to form a one-piece leak proof container 8, see FIG. 5, the blank 10 may be formed of a corrugated cardboard material having an interior portion defined by elongated flutes, generally designated F in FIG. 1, as is generally known in the art, and may be die cut to the shape shown herein, although other materials and variations of the illustrated shape may be provided within the scope of the container described herein. The blank 10 illustrated in FIG. 1 is a planar piece of material in which an inner side 12 is shown facing out of the page and an outer side 14, see FIG. 2, faces in an opposite direction from the inner side 12.

As seen in FIG. 1, the blank 10 extends in a longitudinal direction $L_1$ between first and second longitudinal ends, generally designated 16 and 18, respectively, and further extends in a lateral direction $L_2$, perpendicular to the longitudinal direction $L_1$, between first and second lateral edges, generally designated 20 and 22, respectively. It may be noted that the flutes F extend in the lateral direction $L_2$.

The blank 10 comprises a bottom panel 24 having a plurality of peripheral edges $\mathbf{24}_1$, $\mathbf{24}_2$, $\mathbf{24}_3$, $\mathbf{24}_4$. A first side panel 26 is connected to the bottom panel 24 along a score line at the lateral peripheral edge $\mathbf{24}_3$, and a second side panel 28 is connected the bottom panel 24 along a score line at the opposing lateral peripheral edge $\mathbf{24}_4$. The peripheral edges $\mathbf{24}_1$, $\mathbf{24}_2$, $\mathbf{24}_3$, $\mathbf{24}_4$ define lower edges of the erected container 8.

First and second end portions 30*a*, 30*b* are located at the opposing longitudinal ends 16, 18 of the blank 10. Each end portion 30*a*, 30*b* includes a respective first and second inner end panels 32*a*, 32*b* connected to the longitudinal peripheral edges $\mathbf{24}_1$, $\mathbf{24}_2$ of the bottom panel 24 and extending between the lateral peripheral edges $\mathbf{24}_3$, $\mathbf{24}_4$. The first inner end panel 32*a* can include an outer longitudinal edge defined by a hinge portion 34*a* defined by a double score line $\mathbf{34}a_1$, $\mathbf{34}a_2$, and the second inner end panel 32*b* can include a hinge portion 34*b* defined by a double score line $\mathbf{34}b_1$, $\mathbf{34}b_2$. It should be understood that the inner end panels 32*a*, 32*b* may alternatively comprise hinge portions 34*a*, 34*b* defined by a single score line $\mathbf{34}a_1$, $\mathbf{34}b_1$.

The end portions 30*a*, 30*b* further include respective first and second outer end panels 36*a*, 36*b*. The first outer end panel 36*a* is hingedly joined to the first inner end panel 32*a* at the hinge portion 34*a*, and the second outer end panel 36*b* is hingedly joined to the second inner panel 32*b* at the hinge portion 34*b*. An inner longitudinal edge of the first outer end panel 36*a* can be connected to the first inner end panel 32*a* at the hinge portion 34*a*, and an outer longitudinal edge 16*a* of the first outer end panel 36*a* corresponds to the first longitudinal end 16 of the blank 10. An inner longitudinal edge of the second outer end panel 36*b* can be connected to the second inner end panel 32*b* at the hinge portion 34*b*, and an outer longitudinal edge 18*a* of the second outer end panel 36*b* corresponds to the second longitudinal end 18 of the blank 10. The first and second outer end panels 36*a*, 36*b* can be formed with a longitudinal dimension $D_1$ that is substantially less than a longitudinal dimension $D_2$ of the first and second inner end panels 32*a*, 32*b*.

The first end portion 30*a* additionally includes first and second corner panels 38*a*, 38*b* having inner longitudinal edges connected to the respective first and second side panels 26, 28 at score lines 39$a_1$, 39$b_1$ collinear with the longitudinal peripheral edge 24$_1$, and connected to the first inner end panel 32*a* at respective score lines 39$a_2$, 39$b_2$ collinear with the lateral peripheral edges 24$_3$, 24$_4$. The first and second corner panels 38*a*, 38*b* can each be formed with a square configuration having respective outer longitudinal edges 39$a_3$, 39$b_3$ collinear, or generally collinear with the outer longitudinal edge of the first inner end panel 32*a*, e.g., at the score line 34$a_1$, and having outer lateral edges 39$a_4$, 39$b_4$ collinear with the first and second lateral edges 20, 22, respectively. The first corner panel 38*a* additionally includes a score line defining a respective gusset fold line 38$a_f$ extending diagonally across the corner panel 38*a* from an inner corner defined at an intersection of the score lines 39$a_1$ and 39$a_2$ to an intersection of the outer longitudinal edge 39$a_3$ and outer lateral edge 39$a_4$. Similarly, the second corner panel 38*b* additionally includes a score line defining a respective gusset fold line 38$b_f$ extending diagonally across the corner panel 38*b* from an inner corner defined at an intersection of the score lines 39$b_1$ and 39$b_2$ to an intersection of the outer longitudinal edge 39$b_3$ and outer lateral edge 39$b_4$ The diagonal fold lines 38$a_f$, 38$b_f$ divide the first and second corner panels 38*a*, 38*b* into first and second triangular gusset panels 38$a_1$, 38$a_2$ and 38$b_1$, 38$b_2$, respectively.

The second end portion 30*b* additionally includes first and second corner panels 38*c*, 38*d* having inner longitudinal edges connected to the respective first and second side panels 26, 28 at score lines 39$c_1$, 39$d_1$ collinear with the longitudinal peripheral edge 24$_2$, and connected to the first inner end panel 32*b* at respective score lines 39$c_2$, 39$d_2$ collinear with the lateral peripheral edges 24$_3$, 24$_4$. The first and second corner panels 38*c*, 38*d* can each be formed with a square configuration having respective outer longitudinal edges 39$c_3$, 39$d_3$ collinear, or generally collinear with the outer longitudinal edge of the second inner end panel 32*b*, e.g., at the score line 34$b_1$, and having outer lateral edges 39$c_4$, 39$d_4$ collinear with the first and second lateral edges 20, 22, respectively. The first corner panel 38*c* additionally includes a score line defining a respective gusset fold line 38$c_f$ extending diagonally across the corner panel 38*c* from an inner corner defined at an intersection of the score lines 39$c_1$ and 39$c_2$ to an intersection of the outer longitudinal edge 39$c_3$ and outer lateral edge 39$c_4$. Similarly, the second corner panel 38*d* additionally includes a score line defining a respective gusset fold line 38$d_f$ extending diagonally across the corner panel 38*d* from an inner corner defined at an intersection of the score lines 39$d_1$ and 39$d_2$ to an intersection of the outer longitudinal edge 39$d_3$ and outer lateral edge 39$d_4$ The diagonal fold lines 38$c_f$, 38$d_f$ divide the first and second corner panels 38*c*, 38*d* into first and second triangular gusset panels 38$c_1$, 38$c_2$ and 38$d_1$, 38$d_2$, respectively.

The first outer end panel 36*a* includes a pair of laterally spaced tabs or tab structures 40*a*, 40*b* extending inward from the outer longitudinal edge 16*a* of the outer end panel 36*a* to form a push lock body for the first outer end panel 36*a*. Similarly, the second outer end panel 36*b* includes a pair of laterally spaced tab structures 40*a*, 40*b* extending inward from the outer longitudinal edge 18*a* of the outer end panel 36*b* to form a push lock body for the second outer end panel 36*b*.

Each tab structure 40*a*, 40*b* defines a locking tab and is defined by a longitudinal separation line 42 extending longitudinally inward from a respective outer longitudinal edge 16*a*, 18*a*, and a lateral separation line 44 located longitudinally inward from the respective longitudinal edge 16*a*, 18*a* and intersecting the longitudinal separation line 42 at a free end 46 of the tabs 40*a*, 40*b*, wherein laterally outer edges 42*a* of the tab ends 46 are defined at the longitudinal separation lines 42. The lateral separation lines 44 are spaced from the outer longitudinal edge 16*a*, 18*a* of a respective outer end panel 36*a*, 36*b* a distance $X_1$ that is less than a distance $X_2$ from the lateral separation lines 42 to the respective inner longitudinal ends, e.g., at the hinge portions 34*a*, 34*b*, of the outer end panel 36*a*, 36*b*. The longitudinal separation lines 42 on each outer end panel 36*a*, 36*b* angle laterally inward toward each other extending from the outer longitudinal edge 16*a*, 18*a* of the outer end panel 36*a*, 36*b* toward a respective lateral separation line 44. Further, a hinge connection is defined at a score line 47 between each tab structure 40*a*, 40*b* and a respective outer end panel 36*a*, 36*b*.

As is exemplified in FIG. 1 by the tab structure 40*a* on the outer end panel 36*a*, each lateral separation line 44 is defined by a first, panel edge 44*a* and a second, tab edge 44*b* extending to an inner end 44*c* of the lateral separation line 44, wherein the panel edge 44*a* and the tab edge 44*b* are colinear to the lateral separation line 44, such as may be defined by a straight common knife cut or area. The longitudinal separation line 42 and the lateral separation line 44 can be defined by cut lines, e.g., clean cut lines, that extend completely through the outer end panel 36*a*, 36*b*. However, it may be understood that the separation lines 42, 44 may also be defined by perforations that extend completely or partially through the outer end panels 36*a*, 36*b*.

Referring to FIGS. 2-5 a method of forming the blank 10 into an erected container 8 is described. The side panels 26, 28 and inner end panels 32*a*, 32*b* are initially folded upward from the bottom panel 24. Simultaneously, the corner panels 38*a*, 38*b*, 38*c*, 38*d* can be folded about respective gusset fold lines 38$a_f$, 38$b_f$, 38$c_f$, 38$d_f$ to define gussets 48*a*, 48*b*, 48*c*, 48*d*. Subsequently, the gussets 48*a*, 48*b*, 48*c*, 48*d* can be folded perpendicular to a respective side panel 26, 28 into overlapping relationship with an inner end panel 32*a*, 32*b*, as illustrated by gussets 48*a*, 48*b* in overlapping relationship with the inner end panel 32*a* in FIG. 3. The configuration formed by the folded gussets 48*a*, 48*b*, 48*c*, 48*d* defines folded container corners that form a continuous connection between the side panels 26, 28 and the inner end panels 32*a*, 32*b* extending from the bottom panel 24 to an upper edge 50, see FIG. 5, of the container 8. Hence, the continuous configuration formed by the gussets 48*a*, 48*b*, 48*c*, 48*d* can prevent or substantially limit fluids from leaking out of the container 8 at junctions between the side panels 26, 28 and the inner end panels 32*a*, 32*b*.

Figure 3:
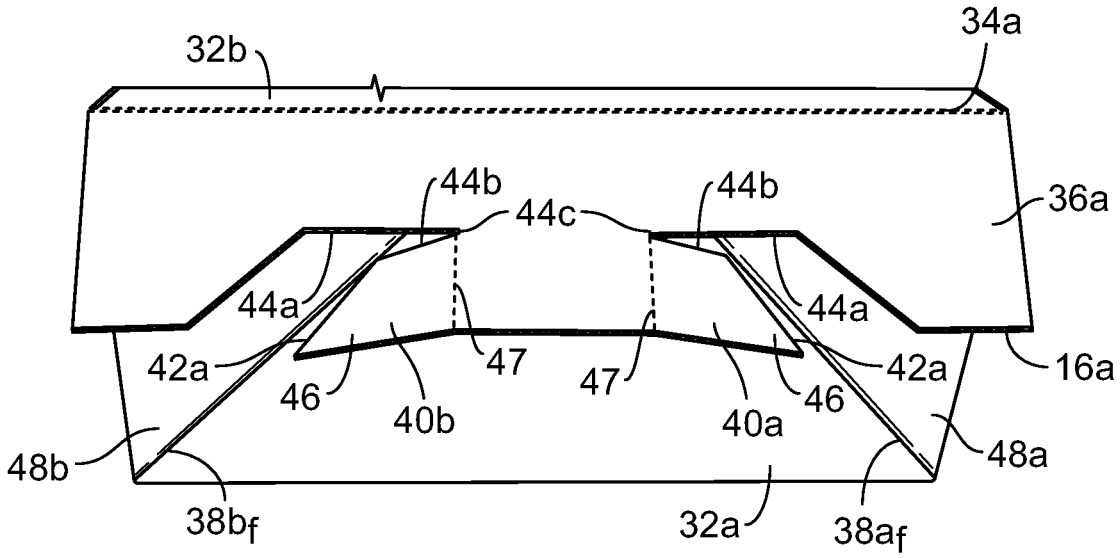
FIG. 3 is a perspective view illustrating folding of gussets over an inner end panel of the container and positioning locking tabs adjacent to edges of the gussets.

In the position depicted in FIG. 3, the outer end panel 36*a* is pivoted about the inner longitudinal edge, i.e., at the hinge portion 34*a*, to a position outwardly spaced from the inner end panel 32*a*. The tab structures 40*a*, 40*b* are pivoted about the score lines 47 to locate the edges 42*a* of the tab ends 46 adjacent to the inner end panel 32*a* near the gusset fold lines 38$a_f$, 38$b_f$ in preparation for positioning the tab ends 46 between the inner end panel 32*a* and the gussets 48*a*, 48*b*.

It may be noted that the angled configuration of the edges 42*a* generally conforms to the angle of the gusset fold lines 38$a_f$, 38$b_f$ which can minimize the pivoting of the tabs 40*a*, 40*b* at the score lines 47 as the edges 42*a* are located near the gusset fold lines 38$a_f$, 38$b_f$.

Figure 4:
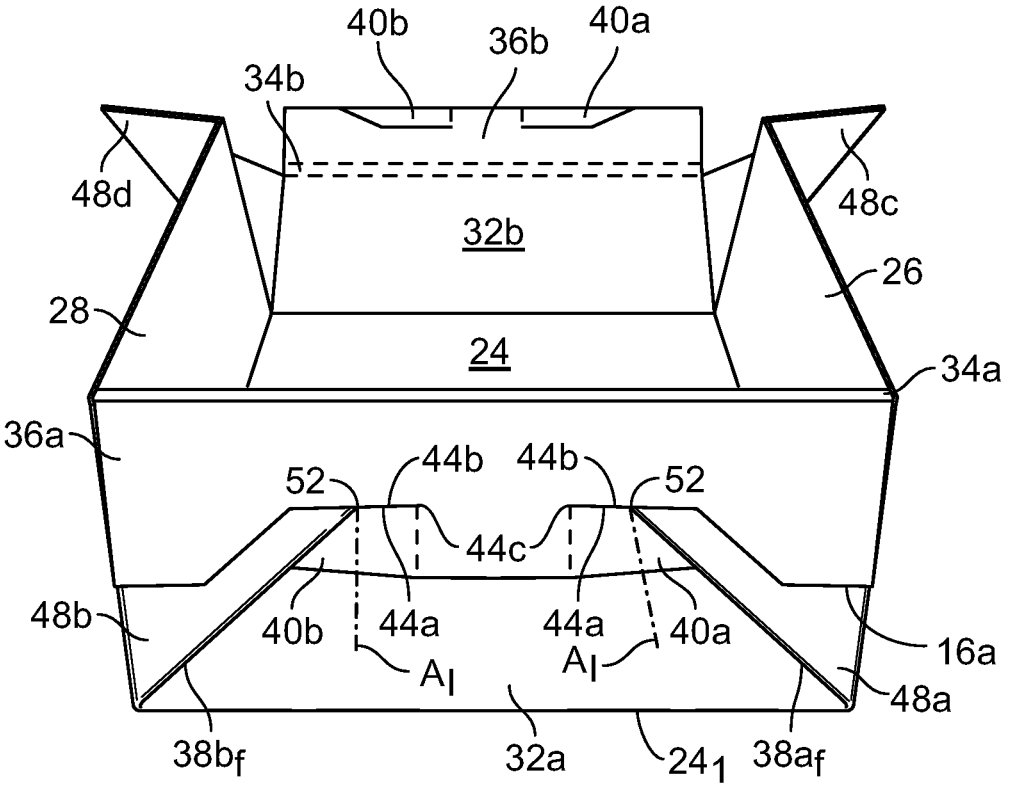
FIG. 4 is a perspective view illustrating inserting the locking tabs behind the gussets to form an end of the container.

As seen in FIG. 4, the outer end panel 36*a* and tabs 40*a*, 40*b* can be pushed inward toward the inner end panel 32*a* to insert the tab ends 46 of the tabs 40*a*, 40*b* between the inner end panel 32*a* and the gussets 48*a*, 48*b*, defining an inserted position of the tabs 40*a*, 40*b*. In the inserted tab position, the gusset fold lines 38$a_f$, 38$b_f$ intersect the respective adjacent panel edges 44*a* and tab edges 44*b* at a common intersection point 52, i.e. along a common intersection axis Ai. Each intersection point 52 defines a close fit between the gusset fold lines 38$a_f$, 38$b_f$ and respective adjacent panel edges 44*a* and tab edges 44*b*, forming a tight locking structure for retaining the outer end panel 36*a* in close overlapping relation over the inner end panel 32*a*, as well as to retain the gussets 48*a*, 48*b* in their folded positions overlapping the inner end panel 32*a*.

It may be noted that the outer longitudinal edges 16*a*, 16*b* of the outer end panels 36*a*, 36*b* may be located in vertically spaced relation from the bottom 24 of the container, i.e., the peripheral edges $\mathbf{24}_1$, $\mathbf{24}_2$. For example, the outer end panels 36*a*, 36*b* may extend approximately half-way down the inner end panels 32*a*, 32*b* to reduce the material required for the outer end panel material while providing sufficient structure to the tabs 40*a*, 40*b* to form a relatively rigid locking structure for retaining the outer end panels 36*a*, 36*b* and gussets 48*a*, 48*b*, 48*c*, 48*d* in their folded position.

Figure 5:
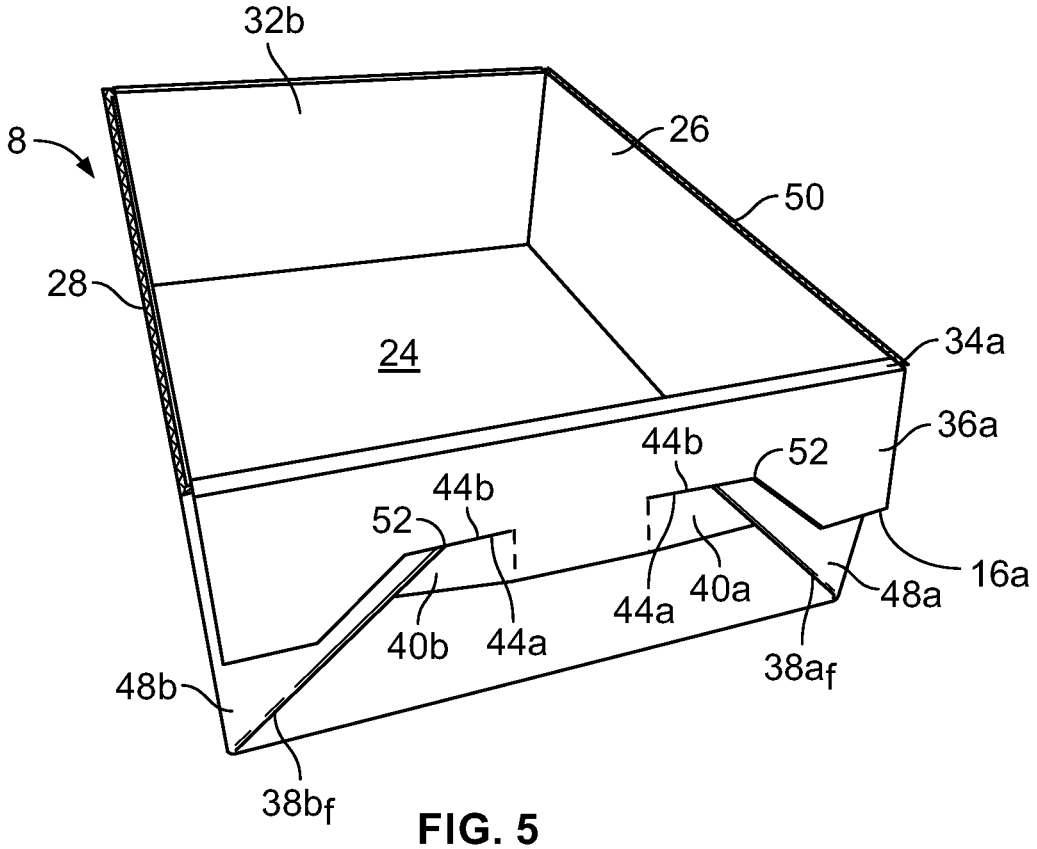
FIG. 5 is a perspective view of the erected leak proof container.

The inner end panel 32*b*, outer end panel 36*b*, and gussets 48*c*, 48*d* forming the opposing end of the container 8 can be folded in manner similar to that described above for the inner end panel 32*a*, outer end panel 36*a*, and gussets 48*a*, 48*b* to form the completed container 8, as illustrated in FIG. 5. The described container provides a configuration that can be readily assembled manually, with positively locking tab structures 40*a*, 40*b* that are conveniently manipulated to provide a securely constructed container. Also, it should be noted that, although the described construction of the container presents the gussets 48*a*, 48*b*, 48*c*, 48*d* being folded outward of the container, the gussets 48*a*, 48*b*, 48*c*, 40*d* may alternatively be folded inward to overlap respective inner sides of the inner end panels 32*a*, 32*b* and the outer end panels 36*a*, 36*b* may be folded inward to place the locking tab structures 40*a*, 40*b* on the inner side of the container.

It may be understood that, by forming the tabs 40*a*, 40*b* with the described separation lines 42, 44, without additional features such as cutouts or slots, the potential for debris created from such cutouts or slots is avoided. Specifically, the blank and associated container described herein can reduce the potential for trim debris within the blank area by providing a clean outside perimeter, with straight cuts, including straight common knife areas, and no internal trim areas. such as are described for the separation lines 42, 44. Hence, the configuration of the blank 10 and resulting container 8 can provide a container for food products that can avoid or substantially reduce contamination as a result of eliminating internal scrap areas, for example, eliminating the release of debris from the blank structure and/or when scrap is released but falls in between plural containers as they are stacked or otherwise grouped together.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blank for making a leak proof container comprising:
a bottom panel having a plurality of peripheral edges;
first and second side panels connected to the bottom panel at opposing lateral peripheral edges and defining lower edges of the container;
first and second end portions located at opposing longitudinal ends of the blank, each end portion including:
an inner end panel connected to a longitudinal peripheral edge of the bottom panel;
an outer end panel having an inner longitudinal edge hingedly connected to a longitudinal edge of the inner end panel;
first and second corner panels, each corner panel having a longitudinal edge connected to a respective one of the first and second side panels and a lateral edge connected to a lateral edge of the inner end panel;
first and second locking tabs defined in the outer end panel, each locking tab defined by a lateral separation line located longitudinally inward from an outer longitudinal edge of the outer end panel and extending laterally to define a free tab end; and
a longitudinal separation line extending longitudinally inward from the outer longitudinal edge of the outer end panel to each of the lateral separation lines, wherein the free ends of the tabs are defined at the longitudinal separation lines.

2. The blank as set forth in claim 1, wherein each lateral separation line is defined by a first, panel edge and a second, tab edge extending to an inner end of the lateral separation line.

3. The blank as set forth in claim 2, wherein the first, panel edge and the second, tab edge are colinear to the lateral separation line.

4. The blank as set forth in claim 1, wherein the longitudinal and lateral separation lines are defined by cut lines that extend completely through the outer end panel.

5. The blank as set forth in claim 4, wherein the longitudinal separation lines angle laterally inward toward each other extending from the outer longitudinal edge of the outer end panel toward a respective lateral separation line.

6. The blank as set forth in claim 1, wherein the lateral separation lines are spaced from the outer longitudinal edge of the outer end panel a distance that is less than a distance from the lateral separation lines to the inner longitudinal edge of the outer end panel.

7. The blank as set forth in claim 1, wherein the corner panels are formed as square panels, and including a diagonal fold line dividing each corner panel into first and second triangular gusset panels.

8. The blank as set forth in claim 7, wherein each corner panel includes a lateral edge that is colinear with a lateral edge of the blank defined by an edge of one of the first and second side panels.

9. The blank as set forth in claim 1, wherein a longitudinal dimension of the outer end panel is substantially less than a longitudinal dimension of the inner end panel.

10. A container including a bottom panel defining a bottom of the container and having a plurality of peripheral edges, first and second side panels connected to the bottom panel at opposing lateral peripheral edges and folded upward relative to the bottom panel, first and second end portions located at opposing longitudinal ends of the blank, each end portion including:

an inner end panel connected to a longitudinal peripheral edge of the bottom panel;

an outer end panel having an inner longitudinal edge hingedly connected to a longitudinal edge of the inner end panel;

first and second corner panels, each corner panel including longitudinal and lateral edges connected to respective edges of a side panel and the inner end panel, each corner panel folded about a diagonal gusset fold line to define a gusset, and each gusset folded perpendicular to a respective side panel to overlapping relationship with the inner end panel;

first and second locking tabs defined in the outer end panel, each locking tab defined by a lateral separation line located longitudinally inward from an outer longitudinal edge of the outer end panel and extending laterally to define a free tab end;

a longitudinal separation line extending longitudinally inward from the outer longitudinal edge of the outer end panel to each of the lateral separation lines, wherein the free ends of the tabs are defined at the longitudinal separation lines; and wherein the outer end panel is folded about the inner longitudinal edge to overlapping relationship with at least a portion of each of the gussets, and the free tab ends are positioned between a respective gusset and the inner end panel to retain the outer end panel in position over the gussets.

11. The container as set forth in claim 10, wherein each lateral separation line is defined by a first, panel edge and an adjacent second, tab edge extending to an inner end of the lateral separation line opposite the free end of the locking tab.

12. The container as set forth in claim 11, wherein the first, panel edge and the second, tab edge are collinear to the separation line.

13. The container as set forth in claim 12, wherein the gusset fold line intersects the first, panel edge and the second, tab edge at a common intersection point.

14. The container as set forth in claim 10, wherein the gusset fold line extends from the bottom of the container to the inner longitudinal edge of the outer end panel.

15. The container as set forth in claim 10, wherein the outer longitudinal edge of the outer end panel is located in spaced relation from the bottom of the container.

* * * * *